US007711307B2

(12) United States Patent
Kageyama

(10) Patent No.: US 7,711,307 B2
(45) Date of Patent: May 4, 2010

(54) CLEANING DEVICE AND IMAGE FORMING APPARATUS INCLUDING SAME

(75) Inventor: Hiroyuki Kageyama, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 705 days.

(21) Appl. No.: 11/602,379

(22) Filed: Nov. 21, 2006

(65) Prior Publication Data

US 2007/0122218 A1 May 31, 2007

(30) Foreign Application Priority Data

Nov. 28, 2005 (JP) ..... 2005-342761

(51) Int. Cl.
*G03G 21/00* (2006.01)

(52) U.S. Cl. ..... 399/350; 399/349; 15/256.51

(58) Field of Classification Search ..... 399/100, 399/101, 327, 343, 346, 349, 350; 15/1.51, 15/256.5, 256.51, 256.52
See application file for complete search history.

(56) References Cited

U.S. PATENT DOCUMENTS

| | | | | |
|---|---|---|---|---|
| 4,022,742 | A * | 5/1977 | Yoshimura et al. | 427/314 |
| 4,970,560 | A * | 11/1990 | Lindblad et al. | 399/350 |
| 5,043,769 | A | 8/1991 | Osawa et al. | |
| 5,450,184 | A * | 9/1995 | Yanai et al. | 399/350 |
| 6,128,461 | A * | 10/2000 | Yoshikawa | 399/350 |
| 6,282,401 | B1 * | 8/2001 | Proulx et al. | 399/350 |
| 2002/0190483 | A1 * | 12/2002 | Murakami et al. | 277/627 |
| 2004/0224245 | A1 | 11/2004 | Shigezaki et al. | |
| 2004/0234294 | A1 * | 11/2004 | Nagame et al. | 399/159 |
| 2005/0063722 | A1 * | 3/2005 | Yoshizawa et al. | 399/53 |
| 2005/0180785 | A1 | 8/2005 | Murakami et al. | |

FOREIGN PATENT DOCUMENTS

| | | | |
|---|---|---|---|
| CN | 1661495 | A | 8/2005 |
| JP | 57-100459 | A | 6/1982 |
| JP | 02-156284 | | 6/1990 |
| JP | 05-072957 | | 3/1993 |
| JP | 09-305082 | | 11/1997 |
| JP | 2001-166657 | | 6/2001 |
| JP | 2002-214993 | | 7/2002 |
| JP | 2002-287592 | | 10/2002 |
| JP | 2003-58009 | A | 2/2003 |
| JP | 2004-086142 | | 3/2004 |
| JP | 2004-101551 | A | 4/2004 |
| JP | 2004-109920 | A | 4/2004 |
| JP | 2005-070196 | | 3/2005 |
| JP | 2005-099340 | | 4/2005 |
| JP | 2005-148403 | | 6/2005 |

* cited by examiner

*Primary Examiner*—David P Porta
*Assistant Examiner*—Benjamin Schmitt
(74) *Attorney, Agent, or Firm*—Nixon & Vanderhye, PC

(57) ABSTRACT

A cleaning device and a blade which is provided in the cleaning device and which has an edge portion to be pressed against a surface of a photoreceptor, so as to scrape toner are arranged so that: the blade includes (a) a blade main body constituting a main body portion of the blade and (b) a fluorocarbon resin layer formed in an edge portion, which is to make contact with the photoreceptor, of the blade main body, the fluorocarbon resin layer being made of a resin material, the resin material being filled in irregularities of a smooth surface of the blade main body. With this, even when the cleaning device is provided in a high-speed machine using small-particle toner with no corner, it is possible to extend the life of the photoreceptor without reducing a cleaning property.

14 Claims, 6 Drawing Sheets

FIG. 7

| EXAMPLES | FLUORIDE COATING TREATMENT | BLADE REPULSIVE ELASTICITY | BRUSH | CLEANABILITY | PHOTORECEPTOR WEARING | PRINTED IMAGE QUALITY | COMPREHENSIVE EVALUATION |
|---|---|---|---|---|---|---|---|
| 1 | IMMERSION IMPREGNATION METHOD (30%) | 40 | NA | △ | ○ | ○ | ○ |
| 2 | IMMERSION IMPREGNATION METHOD (30%) | 50 | NYLON、6d、60kf/inch$^2$ | ○ | ○ | ○ | ◎ |
| 3 | IMMERSION IMPREGNATION METHOD (30%) | 63 | NYLON、6d、60kf/inch$^2$ | ○ | ○ | ○ | ◎ |
| 4 | IMMERSION IMPREGNATION METHOD (45%) | 50 | NA | △ | ○ | ○ | ○ |
| 5 | SPRAY PAINTING METHOD (20%) | 50 | NYLON、6d、60kf/inch$^2$ | ○ | ○ | ○ | ◎ |
| 6 | IMMERSION IMPREGNATION METHOD (30%) | 40 | NA | △ | ○ | ○ | △ |
| 7 | IMMERSION IMPREGNATION METHOD (30%) | 17 | NYLON、6d、60kf/inch$^2$ | △ | △ | △ | △ |

| COMPARATIVE EXAMPLES | FLUORIDE COATING TREATMENT | BLADE REPULSIVE ELASTICITY | BRUSH | CLEANABILITY | PHOTORECEPTOR WEARING | PRINTED IMAGE QUALITY | COMPREHENSIVE EVALUATION |
|---|---|---|---|---|---|---|---|
| 1 | NA | 40 | NYLON、6d、60kf/inch$^2$ | × | × | × | × |
| 2 | NA | 50 | NYLON、6d、60kf/inch$^2$ | × | × | × | × |
| 3 | GENERAL COATING METHOD | 50 | NYLON、6d、60kf/inch$^2$ | × | △ | △ | × |
| 4 | GENERAL COATING METHOD | 63 | NYLON、6d、60kf/inch$^2$ | × | △ | △ | × |

CLEANING DEVICE AND IMAGE FORMING APPARATUS INCLUDING SAME

This Nonprovisional application claims priority under 35 U.S.C. §119(a) on Patent Application No. 342761/2005 filed in Japan on Nov. 28, 2005, the entire contents of which are hereby incorporated by reference.

FIELD OF THE TECHNOLOGY

The present technology relates to a cleaning device which is provided in an image forming apparatus adopting an electrophotographic system and which removes residual toner remaining on a surface of an electrostatic latent image carrier such as a photoreceptor drum. More specifically, the present technology relates to (i) a blade that scrapes toner off a surface of an electrostatic latent image carrier by making contact with the electrostatic latent image carrier, (ii) a cleaning device including the blade, and (iii) an image forming apparatus including the cleaning device.

BACKGROUND OF THE TECHNOLOGY

Conventionally, an image forming apparatus adopting an electrophotographic system has been provided with a cleaning device for removing toner remaining on a photoreceptor serving as an electrostatic latent image carrier. Because of space-saving, design simplicity, mechanism simplicity, and/or other reasons, a cleaning device that is frequently used today uses a blade (cleaning blade) that scrapes toner by making contact with a surface of a photoreceptor.

However, as a recent image forming apparatus operates at a higher speed, the use of a cleaning device with a blade causes a photoreceptor to have a short life span. The reason for this is that: the increase in the operation speed results in a higher processing speed, and this increases an abrasion (decrease in film thickness) of a surface, which makes contact with the blade, of the photoreceptor.

An abrasion of a surface of a photoreceptor may be suppressed, for example, by reducing a coefficient of friction. The following describes examples of conventional techniques for reducing a coefficient of friction.

Japanese Unexamined Patent Publication No. 70196/2005 (Tokukai 2005-70196; published on Mar. 17, 2005) describes a technique in which (i) a plurality of cuts are formed in a portion, which makes contact with a photoreceptor, of a blade and (ii) the cuts are impregnated with a lubricant (zinc stearate). Further, the photoreceptor is provided with a protective layer containing inorganic fine particles made up of alumina or titanium oxide.

Further, Japanese Unexamined Patent Publication No. 86142/2004 (Tokukai 2004-86142; published on Mar. 18, 2004) describes a technique in which a fluorocarbon resin layer is provided as an outermost surface layer of a photoreceptor so that a void on a surface of the photoreceptor is filled with the fluorocarbon resin layer.

Japanese Unexamined Patent Publication No. 72957/1993 (Tokukaihei 5-72957; published on Mar. 26, 1993) describes a technique in which a process for low friction is carried out by (i) adding a fluorocarbon resin into an image area portion of an edge, which makes contact with a photoreceptor, of a blade (mixing a fluorocarbon resin into a blade material) or (ii) applying fluorocarbon paint or silicon paint to the image area portion.

Further, a high-speed machine and a color machine, which have been recent mainstream types of image forming apparatus, use toner (small-particle toner) having a small particle diameter of approximately 5 μm.

However, the conventional arrangements, respectively disclosed in Tokukai 2005-70196, Tokukai 2004-86142, and Tokukaihei 5-72957, in which a coefficient of friction is reduced suffer from the following problems: (1) an effect of reducing the friction of a photoreceptor is insufficient; (2) the reducing effect is not retained; (3) a cleaning property is reduced; and/or (4) electrophotographic performance is degraded.

Specifically, the arrangement, disclosed in Tokukai 2005-70196, in which the cuts are formed in the blade and impregnated with the lubricant is ineffective in reducing a coefficient of friction. This is because each part (having a width of approximately 1 mm) between adjacent cuts is not impregnated with the lubricant. Further, the process of forming the small cuts in the blade requires high accuracy. This raises problems that manufacturing cost is increased and that the blade is likely to be damaged.

Further, the arrangements in which a photoreceptor is processed for the purpose of reducing a coefficient of friction (i.e., (i) the arrangement, disclosed in Tokukai 2005-70196, in which the photoreceptor is provided with the protective layer and (ii) the arrangement, disclosed in Tokukai 2004-86142, in which the fluorocarbon resin layer is provided as the outermost surface layer of the photoreceptor) causes the problem that electrophotographic performance, i.e., a primary function of a photoreceptor is degraded.

Further, according to the arrangement, disclosed in Tokukaihei 5-72957, in which the fluorocarbon resin is added into the edge of the blade, it is hard to realize an accurate edge of the blade which makes contact with (to be pressed against) the photoreceptor. This causes the cleaning property to be reduced.

Meanwhile, according to the arrangement, disclosed in Tokukaihei 5-72957, in which the fluorocarbon paint is applied to the edge of the blade, an area surrounding the edge can be coated, but the edge itself cannot be coated. This causes an insufficient effect of reducing a coefficient of friction. Further, the reducing effect is not retained, because the thin coating causes exfoliating of the coating or other problem to be likely to occur.

The amount of abrasion depends on line pressure (i.e., pressure at which the blade is pressed against the photoreceptor). Therefore, the amount of abrasion can be reduced by reducing the line pressure. However, when the line pressure is reduced, the toner is likely to scrape through a space between the blade and the photoreceptor. This causes the cleaning property to be reduced. On the other hand, when the line pressure is increased giving priority to a cleaning property, a turnover phenomenon occurs (i.e., the blade is turned over), so that a cleaning property is reduced after all.

Recently, small-particle toner has been used for the purpose of obtaining a high-resolution image. Particularly, among others, small-particle toner produced, for example, by a polymerization method is spherical, and it is easy to carry out a shape control of the small-particle toner by which control the cleaning property is considered. Therefore, such toner has been widely used.

Conventionally, when a blade cleans small-particle toner, the motion of the blade sensitively follows the rotation of a photoreceptor. That is, it is preferable that the blade have a high restitution coefficient. However, it has been found that: since the blade has a high coefficient of friction with respect to the photoreceptor, the blade is caused to jump up and down. This results in that a cleaning property cannot be ensured.

SUMMARY OF THE TECHNOLOGY

It is an object of the present technology to provide (i) a cleaning device that makes it possible that the life of a photoreceptor is extended but a cleaning property is not reduced even when a high-speed machine using small-particle toner with no corner is used, (ii) a blade which is provided in the cleaning device, and (iii) an image forming apparatus including the cleaning device.

In order to attain the foregoing object, a blade of a cleaning device is a blade which is provided in a cleaning device for removing a developer from a surface of an electrostatic latent image carrier, the blade, including: a blade main body; and a fluorocarbon resin layer, formed in an edge portion, which is to make contact with the electrostatic latent image carrier, of the blade main body, the fluorocarbon resin layer being made of a resin material, the resin material being filled in irregularities of a smooth surface of the blade main body.

In order to attain the foregoing object, a cleaning device is a cleaning device provided in an image forming apparatus so as to remove a developer from a surface of an electrostatic latent image carrier, the cleaning device, including: a blade, which has an edge portion to be pressed against the surface of the electrostatic latent image, so as to scrape the developer, the blade, including (i) a blade main body constituting a main body portion of the blade and (ii) a fluorocarbon resin layer formed in an edge portion, which is to make contact with the electrostatic latent image carrier, of the blade main body, the fluorocarbon resin layer being made of a resin material, the resin material being filled in irregularities of a smooth surface of the blade main body.

In order to attain the foregoing object, an image forming apparatus includes a cleaning device for removing a developer from a surface of an electrostatic latent image carrier, the cleaning device, including: a blade, which has an edge portion to be pressed against the surface of the electrostatic latent image carrier, so as to scrape the developer, the blade, including (i) a blade main body constituting a main body portion of the blade and (ii) a fluorocarbon resin layer formed in an edge portion, which is to make contact with the electrostatic latent image carrier, of the blade main body, the fluorocarbon resin layer being made of a resin material, the resin material being filled in irregularities of a smooth surface of the blade main body.

With this, the fluorocarbon resin layer is provided in the edge portion, which makes contact with the electrostatic latent image carrier, of the surface of the blade main body of the blade. This makes it possible to reduce a coefficient of friction with respect to the electrostatic latent image carrier, so that the electrostatic latent image carrier is less likely to be damaged.

Moreover, unlike the arrangement, disclosed in Tokukai 2005-70196, in which the cuts are impregnated with the lubricant, the fluorocarbon resin layer is formed entirely in the edge portion that makes contact with the electrostatic latent image carrier. This allows a great effect of reducing a coefficient of friction with respect to the electrostatic latent image carrier.

Moreover, since it is possible to effectively reduce the coefficient of friction with respect to the electrostatic latent image carrier, the blade becomes able to make a short quick smooth stick-slip motion, and the cleaning property for a developer made up of small-particle toner with no corner can be improved. The stick-slip motion will be described later.

Moreover, in this case, the resin material constituting the fluorocarbon resin layer fills the irregularities of the smooth surface of the blade main body. Therefore, even if the fluorocarbon resin layer is gradually scraped away by friction with the electrostatic latent image carrier, the resin material provided between the irregularities of the blade main body is unlikely to be scraped away therefrom. This makes it possible to maintain, for a long period of time, the effect of reducing a coefficient of friction.

With this, even when the cleaning device is provided in a high-speed image forming apparatus using small-particle toner with no corner, a cleaning property is secured while extending the life of the electrostatic latent image carrier.

Additional objects, features, and strengths of the present technology will be made clear by the description below. Further, the advantages of the present technology will be evident from the following explanation in reference to the drawings.

BRIEF DESCRIPTION OF THE DRAWINGS

FIG. 7 is a diagram showing (i) conditions set in Examples and Comparative Examples and (ii) evaluation results obtained in Examples and Comparative Examples.

DESCRIPTION OF THE EMBODIMENTS

An embodiment will be described below with reference to FIGS. 1 to 8. Note that the present technology is not limited to this.

Figure 2:
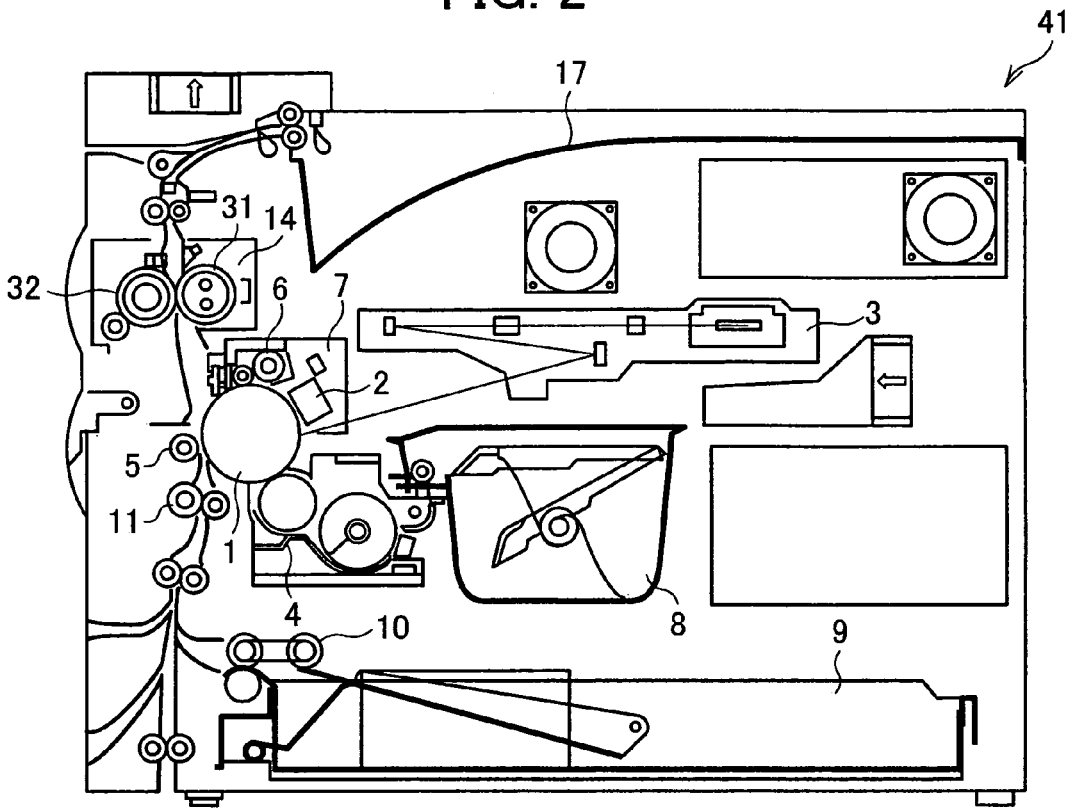
FIG. 2 is a cross-sectional view showing an arrangement of an image forming apparatus including the cleaning device.

First, a whole arrangement of an image forming apparatus (electrophotographic apparatus) 41 including a cleaning device according to the present embodiment will be described with reference to FIG. 2. FIG. 2 is a longitudinal cross sectional view of the image forming apparatus 41 as seen from the front side thereof.

The image forming apparatus 41 forms an image (monochrome image in this case) on a paper sheet in accordance with image data. The image forming apparatus 41 includes a photoreceptor (electrostatic latent image carrier) 1. Provided around the photoreceptor 1 are a charging device 2, an exposure device 3, a two-component developing device 4, a transferring device 5, the cleaning device 6, and an electricity-removing device 7, which constitute a structure for carrying out well-known Carlson process.

The photoreceptor 1 has a shape of a drum. As the photoreceptor 1 rotates, a surface of the photoreceptor 1 is uniformly charged by the charging device 2 so as to have a predetermined potential. The exposure device 3 forms an electrostatic latent image on the surface of the photoreceptor 1 in accordance with image data. The developing device 4 visualizes the electrostatic latent image with toner. The image thus visualized is transferred by the transferring device 5 onto a paper sheet which has been supplied by a pick-up roller 10 from a paper sheet feeding tray 9 and whose top has been aligned with the top of the image. Thereafter, the paper sheet is sent to a fixing device 14. When the paper sheet passes through the fixing device, the toner image is melted and fixed onto the paper sheet. Thereafter, the paper sheet onto which the toner image has been fixed is discharged onto a loading tray 17.

Meanwhile, after the toner image has been transferred onto the paper sheet, the cleaning device 6, which will be fully described later, removes toner remaining on the surface of the photoreceptor 1. Thereafter, the electricity-removing device 7 removes charge remaining on the surface of the photoreceptor 1. Then, the surface of the photoreceptor 1 is recharged by the charging device 2.

Figure 3:
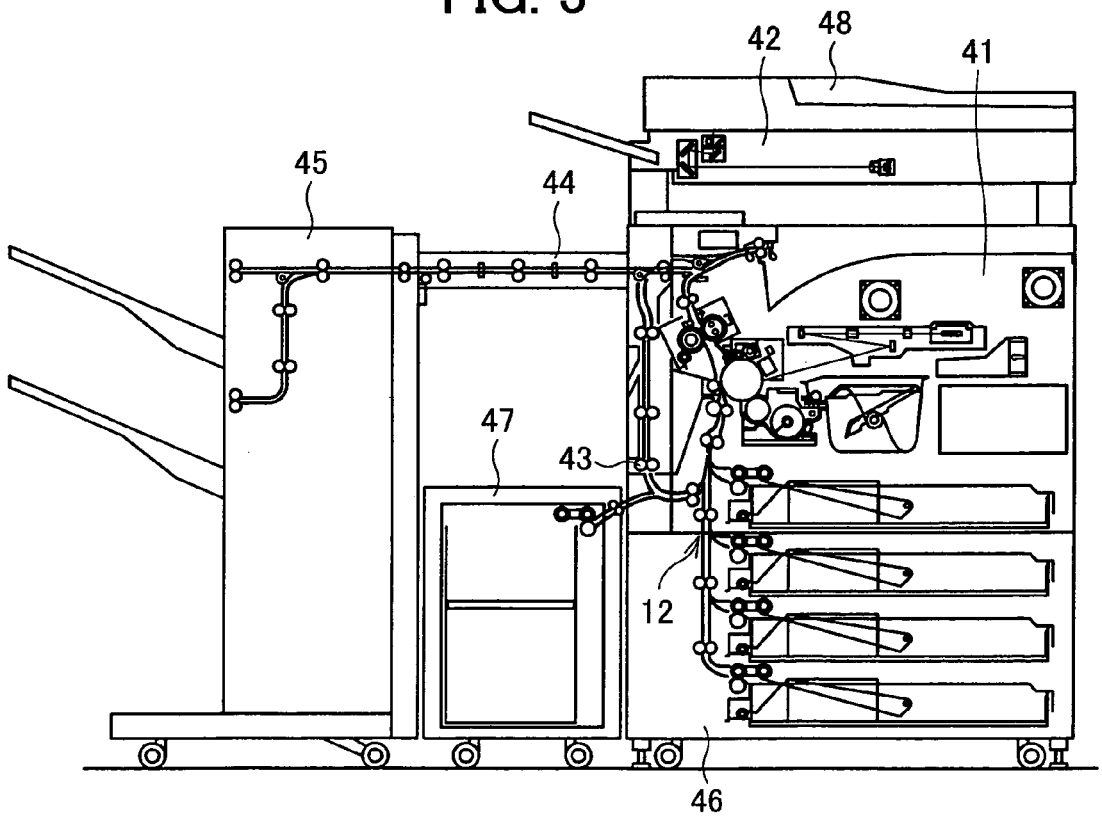
FIG. 3 is a cross-sectional view illustrating that an optional device is added to the image forming apparatus of FIG. 2.

Although no further explanation will be given, the image forming apparatus 41 is able to form images on both sides of the paper sheet by reversing the paper sheet. Further, as shown in FIG. 3, the image forming apparatus 41 can be provided with optional devices such as an image reading device 42, an automatic document feeder 48, a post-processing device 45, a relay transporting device 44, a recording material resupplying device 43, and recording material supplying devices 46 and 47.

Figure 4:
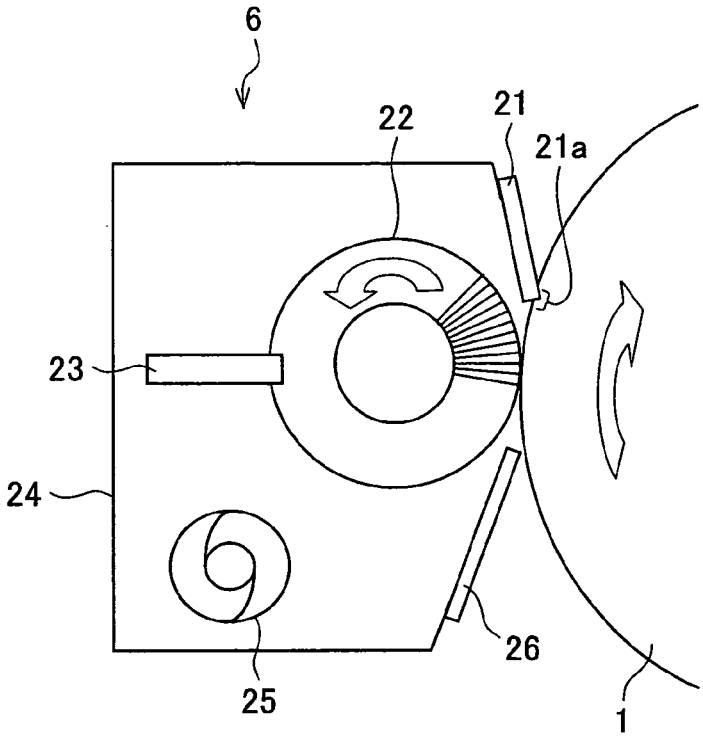
FIG. 4 is a diagram showing an arrangement of the cleaning device.

The following fully explains the cleaning device 6. FIG. 4 shows an arrangement of the cleaning device 6. In FIG. 4, Reference Numeral 21 denotes a blade (cleaning blade) that scrapes the toner remaining on the surface of the photoreceptor 1. The blade 21 is a rectangular rubber member whose longer sides extend in the axial direction of the photoreceptor 1, and is disposed so that: one of the longer sides is fixed in an opening provided in a case 24, so as to be positioned in the downstream side with respect to the rotation direction of the photoreceptor 1; and the other one of the longer sides has an edge (corner) 21*a* that makes contact with the surface of the photoreceptor 1.

The case 24 houses a brush roller 22 and a toner transporting screw 25. The brush roller 22 scatters (flakes) the toner remaining on the surface of the photoreceptor 1. This allows the blade 21 to scrape the toner efficiently. Further, the brush roller 22 also has a function of (i) brushing off the surface of the photoreceptor 1 with its bristles so as to mechanically remove the toner scraped by the blade 21 and (ii) collecting up the toner into the case 24. The brush roller 22 is disposed in such a position that the ends of the bristles of the brush make contact with the surface of the photoreceptor 1 and that the toner scraped and accumulated by the blade 21 can be collected. The brush roller 22 is arranged so as to be rotated in a forward direction with respect to the rotation direction of the photoreceptor 1 (i.e., so as to be rotated in a direction opposite to the rotation direction of the photoreceptor 1). Further, the brush roller 22 is provided with a flicker 23. The flicker 23 hits against toner adhering to the brush roller 22, with the result that the toner falls off from the brush roller 22 to the case 24.

The toner transporting screw 25 is disposed on a bottom surface side of the case 24, and discharges the collected toner into a waste toner box (not shown) provided outside of the case 24. A sealing member 26 is provided in the opening of the case 24 so as to be positioned in the upstream side with respect to the rotation direction of the photoreceptor 1. The sealing member 26 prevents the collected toner from leaking again from the case 24.

Figure 5:
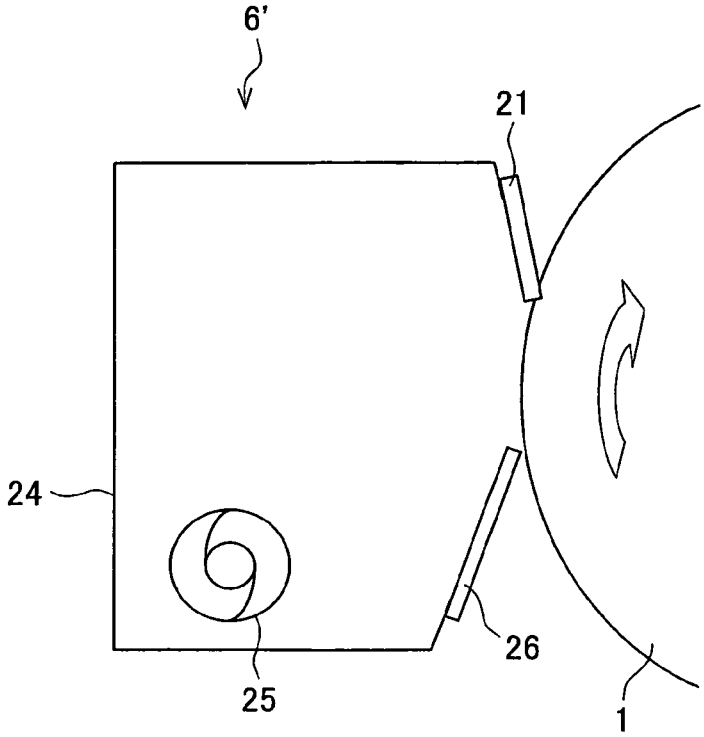
FIG. 5 is a diagram showing another cleaning device including the blade of FIG. 1.

FIG. 4 exemplifies the cleaning device 6 provided with the brush roller 22. However, as shown in FIG. 5, the cleaning device may be a cleaning device 6' provided with no brush roller 22.

Here, attention should be paid to an arrangement of the blade 21 of the cleaning device 6. The blade 21 provided in the cleaning device 6 of the image forming apparatus includes a blade main body 21*d* constituted by a plate elastic member, and a fluorocarbon resin layer 30 made of a resin material, a fluorocarbon resin. The blade main body 21*d* has the edge 21*a* having a portion (hereinafter, referred to as "edge 21*a* portion"), which makes contact with the photoreceptor 1 and on which the fluorocarbon resin layer 30 is so formed as to fill irregularities 21*c* of a surface 21*b* of the blade main body 21*d*.

Figure 1:
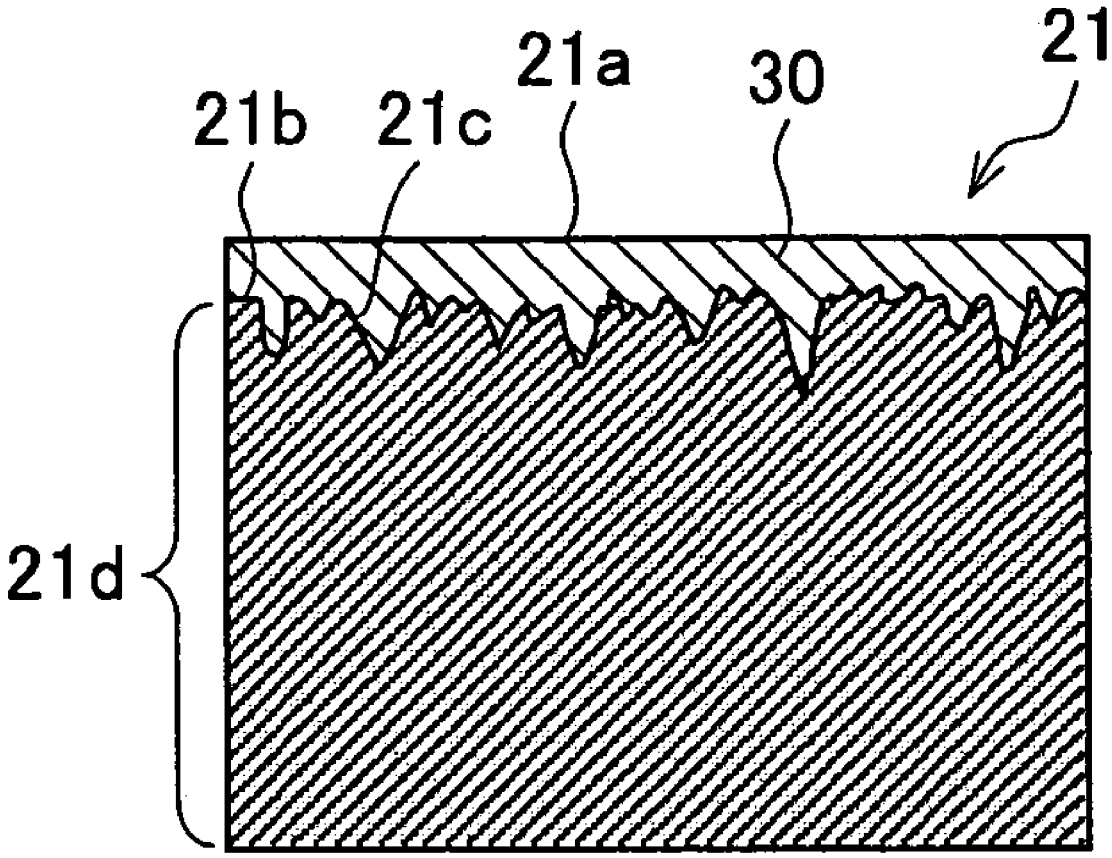
FIG. 1 shows an embodiment, and is a cross-sectional view of a portion, which makes contact with a photoreceptor, of a blade mounted in a cleaning device.

FIG. 1 is a cross-sectional view illustrating a structure of the edge 21*a* portion of the blade 21. The surface 21*b* of the blade main body 21*d* has the irregularities 21*c*, and the fluorocarbon resin layer 30 is so formed as to fill the irregularities 21*c*. The surface 21*b* of the blade main body 21*d* is a smooth surface. The irregularities 21*c* on the surface 21*b* are different from the aforementioned cuts, and are very small irregularities found on a smooth surface of a rubber member. The surface 21*b* preferably has a 10-point average roughness Rz of 0.1 μm to 10 μm (Jis B 0601-1994), more preferably 0.5 μm to 8 μm. When the surface 21*b* has a surface roughness of 10 μm or greater, the cleaning property for toner may be reduced. The reason for this is that: even when a ridge line portion of the blade 21 is pressed against the photoreceptor 1, the ridge line portion is not deformed sufficiently, and a part of the ridge line portion does not make contact with the surface of the photoreceptor 1. On the other hand, when the surface 21*b* has a surface roughness of 0.1 μm or less, the photoreceptor 1 and the ridge line portion of the blade 21 are in increasingly closer contact with each other, so that a targeted low-friction slidability may not be ensured. In view of these, it is preferable that the surface 21*b* of the blade main body 21*d* have a surface roughness Rz of 0.1 μm to 10 μm. Meanwhile, the outermost surface of the photoreceptor 1 has a surface roughness Rz of 0.1 μm to 1.5 μm.

As such, the fluorocarbon resin layer 30 is provided in the edge portion, which makes contact with the photoreceptor 1, of the surface 21*b* of the blade main body 21*d* of the blade 21. This makes it possible to reduce a coefficient of friction with respect to the photoreceptor 1, so that the photoreceptor 1 is less likely to be damaged. Moreover, unlike the arrangement, disclosed in Patent Document 1, in which the cuts are impregnated with the lubricant, the fluorocarbon resin layer 30 is formed entirely in the edge portion that makes contact with the photoreceptor 1. This allows a great effect of reducing a coefficient of friction with respect to the photoreceptor 1.

Figure 6:
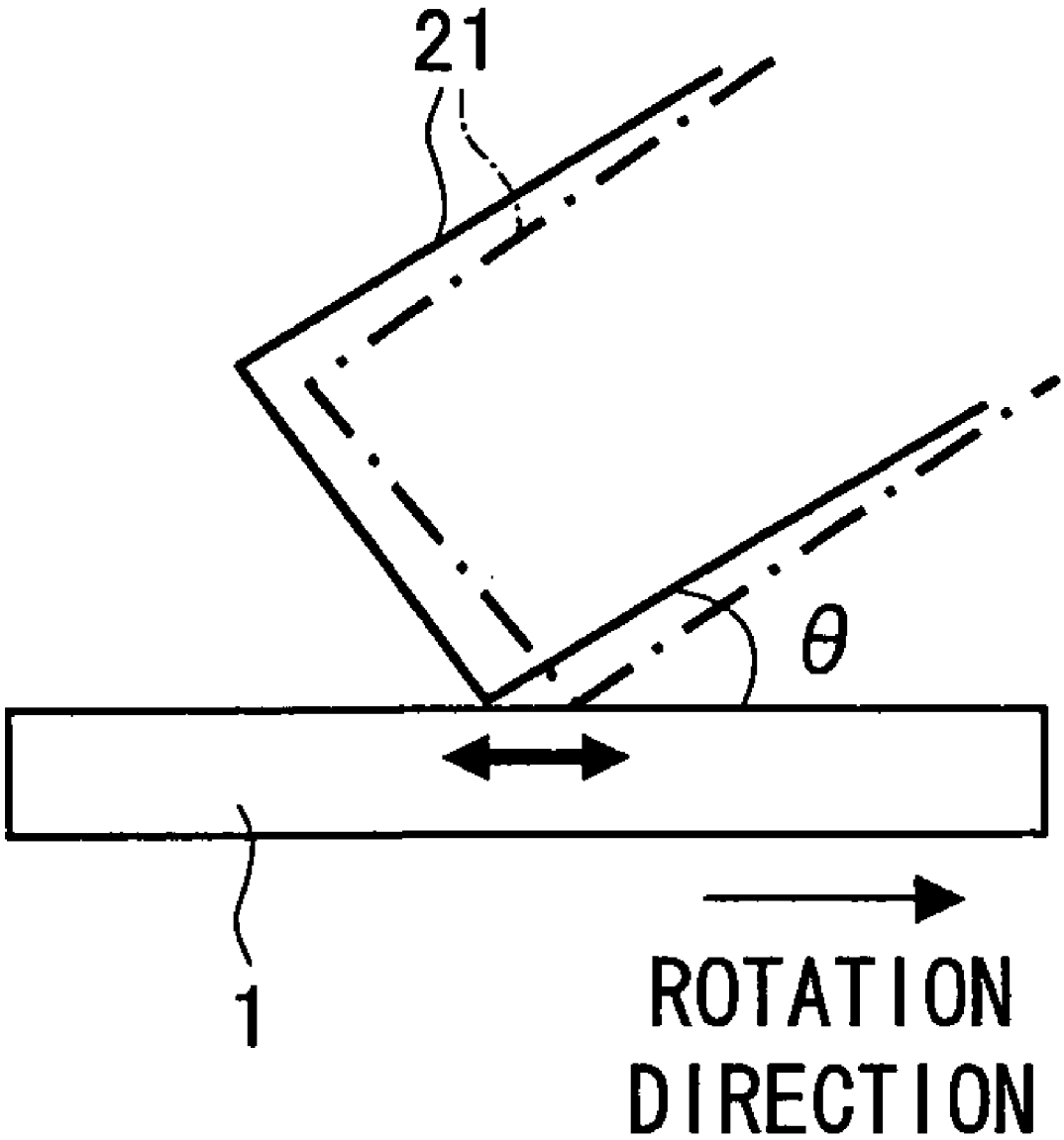
FIG. 6 is a diagram explaining a stick-slip motion of the blade of the cleaning device.

Moreover, since it is possible to effectively reduce the coefficient of friction with respect to the photoreceptor 1, the blade 21 becomes able to make a short quick smooth stick-slip motion, and the cleaning property for a developer made up of small-particle toner with no corner can be improved. As shown in FIG. 6, the stick-slip motion refers to a motion made by alternately repeating (i) such a motion that the contact portion of the blade 21 with the photoreceptor 1 is caused, due to the rotation of the photoreceptor 1, to move in the rotation direction of the photoreceptor 1 and (ii) such a motion that the blade 21 returns to its original position with its own elasticity. That is, the stick-slip motion refers to such a motion that the edge 21*a* of the blade 21 slides on and along the surface on the photoreceptor 1.

Moreover, in this case, the resin material constituting the fluorocarbon resin layer 30 fills the irregularities 21*c* of the smooth surface 21*b* of the blade main body 21*d*. Therefore, even if the fluorocarbon resin layer 30 is gradually scraped away by friction with the photoreceptor 1, the resin material provided between the irregularities 21*c* of the blade main body 21*d* is unlikely to be scraped away therefrom. This makes it possible to maintain, for a long period of time, the effect of reducing a coefficient of friction.

With this, even when the cleaning device 6 is provided in a high-speed image forming apparatus using small-particle toner with no corner, a cleaning property is secured while extending the life of the photoreceptor 1.

The small-particle toner with no corner refers to toner particles having substantially (i) no protrusion where electric charge is likely to concentrate or (ii) no protrusion that is likely to be abraded due to stress. That is, the small-particle toner with no corner refers to such toner particles with no corner that: in cases where a circle having a radius of L/10 (where L is the longer diameter of a toner particle) rolls inside of the circumference of the toner particle in touch with the inside of the circumference at one point, the circle does not substantially go off from the circumference of the toner particle. The case where the circle does not substantially go off from the circumference of the toner particle refers to a case where there is at most one protrusion where the circle goes off from the circumference of the toner particle. Further, the longer diameter of a toner particle refers to a particle width obtained when the distance is longest between two parallel lines sandwiching a projective image of the toner particle on a plane surface.

Here, it was checked whether or not each toner particle used herein has no corner, as follows. That is, first, a close-up picture of a toner particle was taken by using a scanning electron microscope. Next, the close-up picture thus taken was magnified by 15,000 times. Then, it was determined, in accordance with the picture image, whether or not the aforementioned protrusion exists.

A method for obtaining such toner with no corner is not particularly limited. For example, toner with no corner can be obtained by (i) spraying toner particles into a thermal air current, (ii) repeatedly exerting mechanical energy, generated by shock power, to toner particles in the gas phase, or (iii) adding toner to a solvent, in which the toner is never dissolved, and swirling the solvent.

Further, each particle of polymerization toner, to be formed by combining or fusing resin particles with one another, has a surface having a large number of irregularities in a fusion stopping stage, and therefore the surface thereof is not flat and smooth. However, toner with no corner is obtained by appropriately setting (i) a temperature, (ii) the number of times a stirring impeller is rotated, (iii) stirring time, and the like in a shape control step. These conditions vary depending on a property of a constituent resin. For example, by rotating the stirring impeller at a higher speed at a temperature above the glass-transition temperature of the constituent resin, the surface becomes smooth, with the result that toner with no corner is manufactured. The small particle toner refers to toner having a volume average particle diameter of 4 μm to 8 μm.

Further, the term "high-speed machine (high-speed image forming apparatus)" used herein refers to a machine operating at a processing speed of 300 mm/s or faster.

Examples of a material that can be used as the blade main body 21*d* include a plate elastic member made up of urethane rubber, silicon rubber, chloroprene rubber, butadiene rubber, or the like.

Further, the blade main body 21*d* preferably has an irreversible stretch of 1% or less, a tensile strength of 30 MPa to 40 MPa, and a rebound resilience of 40% to 70%. When the blade main body 21*d* has a rebound resilience of less than 40%, the edge portion of the blade 21 gets squashed by making contact with the photoreceptor 1. This causes the blade 21 to make contact with the photoreceptor 1 across a wide range. This may accelerate abrasion of the photoreceptor 1. Further, when the blade main body 21*d* has a rebound resilience of greater than 70%, a stick-slip motion causes large vibrations. This causes the blade 21 to jump up and down. Accordingly, the toner is likely to be scraped through a space between the blade 21 and the photoreceptor 1.

The rebound resilience of the blade main body 21*d* is set to fall within the aforementioned range, so that the blade 21 (i) makes contact with the photoreceptor 1 with its corners kept intact, (ii) does not jump up and down due to a stick-slip motion, and (iii) surely makes a short quick smooth stick-slip motion.

The following explains a method for manufacturing the blade 21. The blade 21 is manufactured by impregnating the blade main body 21*d* with fluorocarbon resin so as to coat the blade main body 21*d* with the fluorocarbon resin.

Examples of the fluorocarbon resin used herein include (i) an alternating copolymer of tetrafluoroethylene (4-ethylene fluoride) and various hydrocarbon vinyl ethers, (ii) an alternating copolymer of 3-fluoride 1-ethylene chloride and various hydrocarbon vinyl ethers, and (iii) a copolymer of vinylidene fluoride and various hydrocarbon vinyl ethers. Among them, the alternating copolymer containing tetrafluoroethylene is preferable.

Further, in order to render the fluorocarbon resin layer 30 durability and tight contact with the blade main body 21*d*, the alternating copolymer of tetrafluoroethylene and various hydrocarbon vinyl ethers may be combined with a cross-linking agent.

For manufacturing simplicity, the blade main body 21*d* is impregnated with the fluorocarbon resin with the use of an aqueous dispersion liquid obtained by dispersing fine particles of the fluorocarbon resin in an aqueous medium, and the aqueous dispersion liquid may contain a solvent or the like. The inclusion of a solvent brings about an effect of (i) improving the wettability of the fluorocarbon resin with respect to the blade and (ii) therefore swelling the surface of the blade. This facilitates the filling of the irregularities 21*c* of the surface 21*b* of the blade main body 21*d* with the fluorocarbon resin. Examples of the solvent used herein include an aromatic solvent and alcohol. Examples of the aqueous medium in which the fluorocarbon resin is dispersed include a blend of pure water and a surfactant, a blend of pure water and a pH adjuster, and a blend of pure water and a viscosity modifier.

Moreover, by immersing, under reduced pressure, the blade main body 21*d* in the aqueous dispersion liquid in which the fluorocarbon resin is dispersed, the irregularities 21*c* of the surface 21*b* of the blade main body 21*d* is filled with the fluorocarbon resin (immersion impregnation method). The pressure on this occasion is preferably 600 Torr or lower, more preferably 300 Torr or lower. Further, for increase of the speed of filling the fluorocarbon resin in the irregularities 21*c* of the surface 21*b* of the blade main body 21*d*, the blade main body 21*d* immersed in the aqueous dispersion liquid may be irradiated with ultrasonic waves. Before immersing the blade main body 21*b* in the aqueous dispersion liquid (fluorocarbon resin dispersion liquid), the blade main body 21*d* may be subjected to an annealing treatment by heating the blade main body 21*d* for approximately one hour at approximately 60° C. to 80° C. in a drying furnace. The blade main body 21*d* thus subjected to the annealing treatment is easily impregnated with the aqueous dispersion liquid.

The fluorocarbon resin can be filled in the irregularities 21*c* of the surface 21*b* by using a method other than the immersion impregnation method. For example, the aqueous dispersion liquid is sprayed onto the blade main body 21*d* in accordance with a spray coating method so that the fluorocarbon resin adheres to the blade main body 21*d*. Then, the blade main body 21*d* is heated to 50° C. or higher, preferably 60° C. or higher, so that the fluorocarbon resin is filled in the irregularities 21*c* of the surface 21*b*.

The thickness of the fluorocarbon resin layer 30 thus obtained is not particularly limited as long as the fluorocarbon resin layer 30 ensures sufficient elasticity and sufficient tight contact with the surface of the photoreceptor 1 for removal of remaining substance (toner or the like) from the surface of the photoreceptor 1.

Such a blade 21 is formed so as to have, e.g., a free end length of 9.0 mm (have shorter sides each having a length of 9.0 mm), a thickness of 2.0 mm, and a whole length of 326 mm (have longer sides each having a length of 326 mm), and is brought into contact with the photoreceptor 1 having a diameter of 80 mm in accordance with a leading method and a constant load method. Further, the blade 21 is preferably set so as to (i) exert a line pressure of 0.5 gf/mm to 2.5 gf/mm (0.05 N/cm to 0.25 N/cm) onto the photoreceptor 1, (ii) clean the photoreceptor 1 at a cleaning angle of 8° to 17°, and (iii) be depressed by 0.3 mm to 1.5 mm when pressed against the photoreceptor 1.

The cleaning angle of the blade 21 refers to an angle θ (see FIG. 6) formed, in the downstream side of the rotation direction of the photoreceptor 1, between (i) the surface of the photoreceptor 1 on which surface the edge 21*a* of the blade 21 put under load via a blade holder slides and (ii) the surface of the blade 21 which surface faces the photoreceptor 1. A larger cleaning angle θ increases a degree of freedom that the tip (edge 21*a* portion) of the blade 21 moves in a sliding direction in contact with the photoreceptor 1, and therefore is good for a stick-slip motion. This makes it possible to realize a smooth stick-slip motion. However, too large a cleaning angle θ is likely to cause (i) an increase in torque on the photoreceptor 1, (ii) a turnover phenomenon of the blade 21, or (iii) damage of the edge 21*a* of the blade 21 under such an environment and/or condition that the friction between the blade 21 and the surface of the photoreceptor 1 is very high.

In light of this, according to the present embodiment, the cleaning angle θ is set to fall within the aforementioned range. This makes it possible that a stick-slip motion is realized without the aforementioned problems even under such an environment and/or condition that the friction between the blade 21 and the surface of the photoreceptor 1 is very high.

The higher the line pressure of the blade 21 is, the more difficult it is that the blade 21 is pushed up by the toner adhering to the surface of the photoreceptor 1. Therefore, the toner is surely subjected to force by which the toner is accumulated. However, too high a line pressure prevents a stick-slip motion, and therefore is not good for cleaning.

In light of this, in the present embodiment, the line pressure is set to fall within the aforementioned range. This makes it possible that an effective stick-slip motion is made and that a good cleaning property is obtained by surely preventing the toner from passing through a space between the blade 21 and the photoreceptor 1.

The following explains Examples of the cleaning device and Comparative Examples. In Examples, blade main bodies having different repulsive elasticities were prepared. Some of the blades main bodies 21*d* were heated in advance for one hour at 80° C. in a drying furnace. Next, the blade main bodies 21*d* were brought into a chamber. In the chamber, the blade main bodies 21*b* were immersed in an aqueous dispersion liquid for 10 minutes under a reduced pressure of 300 Torr. The aqueous dispersion liquid contains alcohol, and approximately 0.1 μm particles of fluorocarbon resin and approximately 0.1 μm particles of a hardening agent are dispersed in the aqueous dispersion liquid. Thereafter, the pressure exerted onto the blade main bodies 21*b* were brought back to normal pressure. The aqueous dispersion liquid adhering to a surface of each of the blade main bodies 21*b* was removed. Then, the blade main bodies 21*b* were dried for 3 hours at 40° C. As a result, blades 21 were obtained (immersion impregnation method).

Further, an aqueous dispersion liquid in which fluorocarbon resin containing an aromatic solvent had been dispersed was sprayed onto the other one of the blade main bodies by using a spray application method. Thereafter, the blade main body was dried for one hour at 80° C. As a result, a blade 21 was obtained (spray impregnation method).

Figure 9:
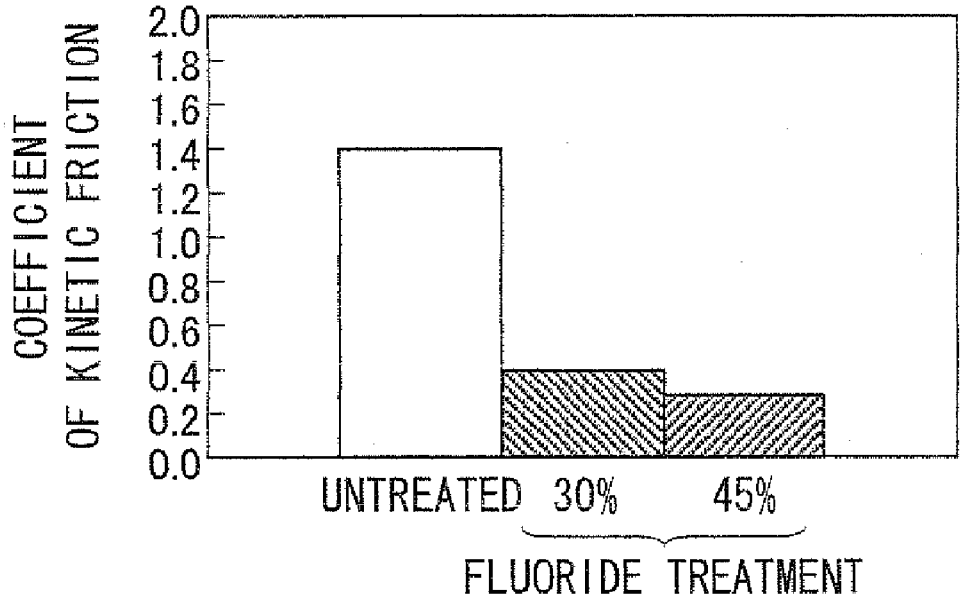
FIG. 9 is a graph showing the relationship between (i) a fluoride treatment of a blade and (ii) a coefficient of kinetic friction between the blade and a photoreceptor.

FIG. 9 shows a result of finding out (1) a coefficient of kinetic friction between (i) each of blades whose blade main bodies have been subjected to the fluoride treatment and (ii) a photoreceptor and (2) a coefficient of kinetic friction between (a) each of blades whose blade main bodies have not been subjected to the fluoride treatment and (b) the photoreceptor. In this case, two types of fluoride treatment were carried out: (i) a fluoride treatment using a processing solvent having a fluorocarbon resin content of 30% and (ii) a fluoride treatment using a processing solvent having a fluorocarbon resin content of 45%. The properties of the blade main bodies used herein are as follows. That is, each of the blade main bodies has a hardness (Jis scale) of 70°, a rebound resilience of 50%, a Young's modulus of 6.4 MPa, and a tensile strength of 33.3 MPa.

FIG. 9 shows that the coefficient of kinetic friction of the fluoride-treated blade is much lower than the coefficient of kinetic friction of the untreated blade. Moreover, FIG. 9 shows that the processing solvent having the higher fluorocarbon resin content has a higher effect of reducing a coefficient of kinetic friction.

Each of the blades 21 thus obtained was provided in (i) the cleaning device 6 (see FIG. 4) which has the brush roller 22 and (ii) the cleaning device 6'(see FIG. 5) which has no brush roller 22. Each of the cleaning devices 6 and 6' was incorporated into an image forming apparatus. The cleaning property, photoreceptor wearing characteristic, and printed image quality of the image forming apparatus were evaluated. Then, the comprehensive evaluation thereof was made. The image forming apparatus operates at a processing speed of 395 mm/sec.

On the other hand, blades 21 of Comparative Examples were obtained as follows. That is, some of the blades 21 were obtained without forming a fluorocarbon resin layer on blade main bodies 21*d* identical to those of Examples. The rest of the blades 21 were obtained as follows. Blade main bodies 21*d* identical to those of Examples were not subjected to heat treatment, but fluorocarbon coating material was applied and adhered to the blade main bodies 21*d* with the use of a brush in accordance with a general application method. Each of the blades 21 thus obtained was provided in the cleaning device 6 shown in FIG. 4. As with Examples, the cleaning device 6 was incorporated into an image forming apparatus. The cleaning property, photoreceptor wearing characteristic, and printed image quality of the image forming apparatus were evaluated. Then, the comprehensive evaluation thereof was made. The image forming apparatus operates at a processing speed of 395 mm/sec.

In Examples and Comparative Examples, each blade main body 21*d* has a free end length of 9.0 mm (has shorter sides each having a length of 9.0 mm), a thickness of 2.0 mm, and a whole length of 326 mm (has longer sides each having a length of 326 mm), and is brought into contact with the photoreceptor 1 having a diameter of 80 mm in accordance with a leading method and a constant load method.

The evaluation of a cleaning property was carried out as follows. The symbol "○" represents a case where no streaks appears on the surface of the photoreceptor due to uncollected toner even when 300K (300,000) paper sheets had been printed (subjected to image formation). The symbol "Δ" represents a case where uncollected toner left streaks partially on the surface of the photoreceptor 1 when 300K paper sheets had been printed. The symbol "X" represents a case where uncollected toner left streaks across a wide range on the surface of the photoreceptor 1 when 1K (1,000) paper sheets had been printed.

The evaluation of photoreceptor wearing characteristic was carried out as follows. For the evaluation, a photoreceptor having an initial film thickness of 30 μm was used. The symbol "○" represents a case where the photoreceptor had an amount of abrasion of 3 μm or less per 100K (100,000) paper sheets and had no damage. The symbol "Δ" represents a case where the photoreceptor had an amount of abrasion of 3 μm to 5 μm per 100K (100,000) paper sheets and had no damage. The symbol "X" represents a case where the photoreceptor had an amount of abrasion of 5 μm or greater per 100K (100,000) and had damage.

The evaluation of printed image quality was carried out as follows. The symbol "○" represents a case where a printed image was good when checked with eyes. The symbol "Δ" represents a case where a printed image had some streaks. The symbol "X" represents a case where a printed image was defective. The comprehensive evaluation was carried out based on the following scales: ◎=Excellent; ○=Good; Δ=Acceptable (the blade can be practically used without problems); and X=Poor (the blade cannot be practically used).

FIG. 7 shows (i) conditions set in Examples and Comparative Examples and (ii) evaluation results obtained in Examples and Comparative Examples. The symbol "%" in parentheses in the column "FLUORIDE COATING METHOD" indicates the amount of fluorocarbon resin contained in the aqueous dispersion liquid. The symbol "NA" in the column "BRUSH" indicates a result obtained when the blade was provided in the cleaning device 6'(see FIG. 5) which has no brush roller 22. The symbol "d" in the column "BRUSH" indicates the thickness of each of brush bristles, and "**6*d***" means "6 deniers". Further, the symbol "f/inch$^2$" in the column "BRUSH" indicates the density of brush bristles, and "60 kf/inch$^2$" represents a case where 60,000 brush bristles are planted per inch$^2$.

A comparison among Examples clearly shows that the brush roller 22 allows improvement of a cleaning property. Further, the comprehensive evaluation of Example 7 in which the blade main body has a low rebound resilience of 17% shows that the blade of Example 7 is practically usable. However, even though the brush roller 22 was provided, the cleaning property of the blade of Example 7 was evaluated as "A", and the photoreceptor wearing characteristic of the blade of Example 7 is lower than that of other blades having a higher rebound resilience.

A comparison between Examples and Comparative Examples clearly shows that the use of the blades having not been subjected to the fluoride coating treatment resulted in evaluation "X" in terms of all of the cleaning property, photoreceptor wearing characteristic, printed image quality, and comprehensive evaluation even though each of the blade main bodies of the blades had the aforementioned preferable rebound resilience. Further, the respective photoreceptor wearing characteristics of the blades each having the fluorocarbon resin layer formed by using the general coating method were evaluated as "Δ". However, even though the brush roller 22 was provided, the cleaning property was evaluated as "X", and the blades were therefore useless.

Figure 8:
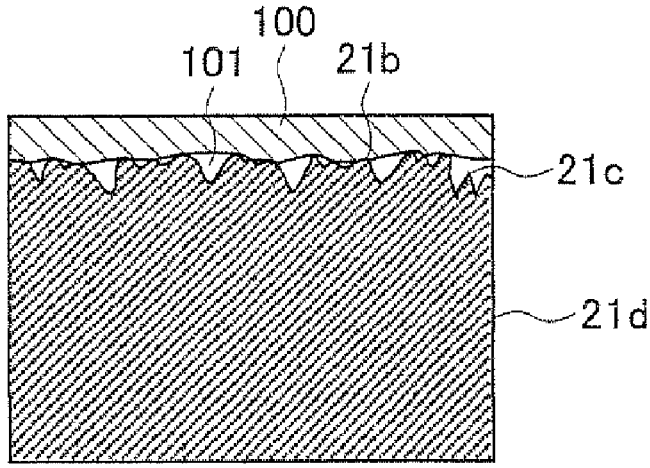
FIG. 8 is a cross-sectional view showing a portion, which makes contact with a photoreceptor, of a conventional blade serving as a Comparative Example.

FIG. 8 is a cross sectional view illustrating each structure of the blades of Comparative Examples 3 and 4. Each of the blades has a fluorocarbon resin layer 100 formed by using a general coating method. The fluorocarbon resin layer 100 is not filled in the irregularities 21*c* of the surface 21*b* of the blade 21, but is formed so that air 101 is contained in a space between the fluorocarbon resin layer 100 and the irregularities 21*c* of the surface 21*b*. When such a fluorocarbon resin layer 100 wears due to friction with the photoreceptor 1 and the irregularities 21*c* are accordingly exposed, the blade becomes similar to the untreated blades. Therefore, the coefficient of friction is increased rapidly immediately after the irregularities 21*c* are exposed.

In contrast, the fluorocarbon resin layer 30 is filled in the irregularities 21*c* of the surface 21*b* of the blade 21 (see FIG. 1). Therefore, even when the fluorocarbon resin layer 30 wears due to friction with the photoreceptor 1 and the irregularities 21*c* are accordingly exposed, the blade 21 does not become similar to the untreated blade and there is no rapid increase in a coefficient of friction.

As described above, a blade of a cleaning device is a blade which is provided in a cleaning device for removing a developer from a surface of an electrostatic latent image carrier, the blade, including: a blade main body; and a fluorocarbon resin layer, formed in an edge portion, which is to make contact with the electrostatic latent image carrier, of the blade main body, the fluorocarbon resin layer being made of a resin material, the resin material being filled in irregularities of a smooth surface of the blade main body.

With this, the fluorocarbon resin layer is provided in the edge portion, which makes contact with the electrostatic latent image carrier, of the surface of the blade main body. This makes it possible to reduce a coefficient of friction with respect to the electrostatic latent image carrier, so that the electrostatic latent image carrier is less likely to be damaged. Moreover, unlike the arrangement, disclosed in Patent Document 1, in which the cuts are impregnated with the lubricant, the fluorocarbon resin layer is formed entirely in the edge portion that makes contact with the electrostatic latent image carrier. This allows a great effect of reducing a coefficient of friction with respect to the electrostatic latent image carrier.

Moreover, since it is possible to effectively reduce the coefficient of friction with respect to the electrostatic latent image carrier, the blade becomes able to make a short quick smooth stick-slip motion, and the cleaning property for a developer made up of small-particle toner with no corner can be improved.

Moreover, in this case, the resin material constituting the fluorocarbon resin layer fills the irregularities of the smooth surface of the blade main body. Therefore, even if the fluorocarbon resin layer is gradually scraped away by friction with the electrostatic latent image carrier, the resin material provided between the irregularities of the blade main body is unlikely to be scraped away therefrom. This makes it possible to maintain, for a long period of time, the effect of reducing a coefficient of friction.

With this, the use of the blade makes it possible to provide such a cleaning device that: even when the cleaning device is provided in a high-speed image forming apparatus using small-particle toner with no corner, a cleaning property is secured while extending the life of the electrostatic latent image carrier.

The blade main body can be made up of urethane rubber, silicon rubber, chloroprene rubber, or butadiene rubber. Further, a smooth surface, which has irregularities, of the blade main body preferably has a surface roughness, i.e., 10-point average roughness Rz of 0.1 μm to 10 μm (Jis B 0601-1994), more preferably 0.5 μm to 8 μm. When the surface has a surface roughness of 10 μm or greater, the cleaning property for toner may be reduced. The reason for this is that: even when a ridge line portion of the blade is pressed against the electrostatic latent image carrier, the ridge line portion is not deformed sufficiently, and a part of the ridge line portion does not make contact with the surface of the electrostatic latent image carrier. On the other hand, when the surface has a surface roughness of 0.1 μm or less, the electrostatic latent image carrier and the ridge line portion of the blade are in increasingly closer contact with each other, so that a targeted low-friction slidability may not be ensured. In view of these, it is preferable that the blade main body have a surface roughness Rz of 0.1 μm to 10 μm.

Further, according to the blade of the cleaning device, the blade main body has a rebound resilience of 40% to 70%, more preferably 45% to 65%.

When the blade main body has a rebound resilience of less than 40%, the edge portion of the blade gets squashed by making contact with the electrostatic latent image carrier. This causes the blade to make contact with the electrostatic latent image carrier across a wide range. This may accelerate abrasion of the electrostatic latent image carrier. Further, when the blade main body has a rebound resilience of greater than 70%, a stick-slip motion causes large vibrations. This causes the blade to jump up and down. Accordingly, the toner is likely to be scraped through a space between the blade and the electrostatic latent image carrier.

The rebound resilience of the blade main body is set to fall within the aforementioned range, so that the blade (i) makes contact with the electrostatic latent image carrier with its corners kept intact, (ii) does not jump up and down due to a stick-slip motion, and (iii) surely makes a short quick smooth stick-slip motion.

The properties used were measured in conformity to JIS K6301 vulcanized rubber physical testing method.

With a the blade of the cleaning device, the fluorocarbon resin layer is formed by immersing, under reduced pressure, the blade main body in an aqueous dispersion liquid in which fluorocarbon resin is dispersed. Alternatively, the fluorocarbon resin layer is formed by (i) applying, to the blade main body in accordance with a spray application method, an aqueous dispersion liquid in which fluorocarbon resin is dispersed, and (ii) heating the blade main body after the application.

In order to solve the foregoing problems, a cleaning device is a cleaning device provided in an image forming apparatus so as to remove a developer from a surface of an electrostatic latent image carrier, the cleaning device, including: a blade, which has an edge portion to be pressed against the surface of the electrostatic latent image, so as to scrape the developer, the blade, including (i) a blade main body constituting a main body portion of the blade and (ii) a fluorocarbon resin layer formed in an edge portion, which is to make contact with the electrostatic latent image carrier, of the blade main body, the fluorocarbon resin layer being made of a resin material, the resin material being filled in irregularities of a smooth surface of the blade main body.

As already explained as a blade, the cleaning device uses the blade of the present technology. Therefore, even when the cleaning device is provided in a high-speed machine using small-particle toner with no corner, a cleaning property is secured while extending the life of the electrostatic latent image carrier.

The cleaning device is preferably arranged so as to further include: a rotary brush, which is provided in an upstream side of a rotation direction of the electrostatic latent image carrier with respect to the blade and which rotates in touch with the electrostatic latent image carrier.

With this, the rotary brush makes contact with the developer adhering to the electrostatic latent image carrier, with the result that the developer is flaked so as to be scraped by the blade more efficiently. This makes it possible to further improve a cleaning property.

The embodiments and concrete examples of implementation discussed in the foregoing detailed explanation serve solely to illustrate the technical details of the present technology, which should not be narrowly interpreted within the limits of such embodiments and concrete examples, but rather may be applied in many variations within the spirit of the present technology, provided such variations do not exceed the scope of the patent claims set forth below.

What is claimed is:

1. A blade, which is provided in a cleaning device for removing a developer from a surface of an electrostatic latent image carrier, the blade, comprising:

a blade main body, wherein irregular voids are present on surfaces of the blade main body; and a fluorocarbon resin layer, formed on an edge portion of the blade main body which is to make contact with the electrostatic latent image carrier, the fluorocarbon resin layer being made of a resin material, wherein the fluorocarbon resin layer is formed by immersing, under reduced pressure, the blade main body in an aqueous dispersion liquid in which fluorocarbon resin is dispersed, the resin material substantially filling the irregular voids in the surface of the blade main body, and wherein the blade is configured to remove developer from a surface of an electrostatic latent image carrier via a slip-stick motion.

2. The blade as set forth in claim 1, wherein the edge portion of the blade main body has a 10-point average roughness Rz of 0.1 μm to 10 μm, the 10-point average roughness indicating a surface roughness.

3. The blade as set forth in claim 1, wherein the blade main body has a rebound resilience of 40% to 70%.

4. The blade as set forth in claim 1, wherein the blade main body is made of urethane rubber, silicon rubber, chloroprene rubber, or butadiene rubber.

5. The blade of claim 1, wherein the fluorocarbon resin layer is formed on the edge portion of the blade main body such that the fluorocarbon resin layer is formed on upper and lower surfaces of the blade main body, and a tip that extends between the upper and lower surfaces.

6. A cleaning device, which is provided in an image forming apparatus so as to remove a developer from a surface of an electrostatic latent image carrier, the cleaning device, comprising:

a blade, which has an edge portion to be pressed against the surface of the electrostatic latent image carrier, so as to scrape the developer via a slip-stick motion, the blade including:

(i) a blade main body constituting a main body portion of the blade, wherein irregularities are formed on a surface of the edge portion of the blade main body; and (ii) a fluorocarbon resin layer formed on the edge portion of the blade main body which is to make contact with the electrostatic latent image carrier, the fluorocarbon resin layer being made of a resin material, wherein the fluorocarbon resin layer is formed by immersing, under reduced pressure, the blade main body in an aqueous dispersion liquid in which fluorocarbon resin is dispersed, the resin material filling the irregularities on the surface of the blade main body.

7. The cleaning device as set forth in clam 6, further comprising:

a rotary brush, which is provided in an upstream side of a rotation direction of the electrostatic latent image carrier with respect to the blade and which rotates in touch with the electrostatic latent image carrier.

8. The cleaning device of claim 6, wherein the fluorocarbon resin layer is formed on the edge portion of the blade main body such that the fluorocarbon resin layer is formed on upper and lower surfaces of the blade main body, and a tip that extends between the upper and lower surfaces.

9. An image forming apparatus, comprising a cleaning device for removing a developer from a surface of an electrostatic latent image carrier, the cleaning device, including:

a blade, which has an edge portion to be pressed against the surface of the electrostatic latent image carrier, so as to scrape the developer via a slip-stick motion, the blade including:

(i) a blade main body constituting a main body portion of the blade, wherein irregularities are formed on a surface of the edge portion of the blade main body; and (ii) a fluorocarbon resin layer formed on the edge portion of the blade main body which is to make contact with the electrostatic latent image carrier, the fluorocarbon resin layer being made of a resin material, wherein the fluorocarbon resin layer is formed by immersing, under reduced pressure, the blade main body in an aqueous dispersion liquid in which fluorocarbon resin is dispersed, the resin material filling the irregularities in the surface of the blade main body.

10. The image forming apparatus as set forth in claim 9, further comprising:

a rotary brush, which is provided in an upstream side of a rotation direction of the electrostatic latent image carrier with respect to the blade of the cleaning device and which rotates in touch with the electrostatic latent image carrier.

11. The image forming apparatus of claim 9, wherein the fluorocarbon resin layer is formed on the edge portion of the blade main body such that the fluorocarbon resin layer is formed on upper and lower surfaces of the blade main body, and a tip that extends between the upper and lower surfaces.

12. The image forming apparatus of claim 9, wherein the blade main body has a rebound resilience of 40% to 70%.

13. The image forming apparatus of claim 9, wherein the blade exerts a line pressure of 0.05 N/cm to 0.25 N/cm onto the electrostatic latent image carrier.

14. The image forming apparatus of claim 9, wherein the blade cleans the electrostatic latent image carrier at a cleaning angle of 8° to 17° when pressed against the electrostatic latent image carrier.

* * * * *